United States Patent [19]

Tinkler et al.

[11] Patent Number: 4,649,847

[45] Date of Patent: Mar. 17, 1987

[54] HULL CONSTRUCTION

[76] Inventors: Robert C. Tinkler, 725 Morehouse Hwy., Fairfield, Conn. 06430; Michael R. Tinkler, 545 Ulumalu Rd., Haiku, Hi. 96708

[21] Appl. No.: 719,988

[22] Filed: Apr. 4, 1985

[51] Int. Cl.[4] ..... A63C 15/00

[52] U.S. Cl. ..... 114/39; 441/68; 441/74

[58] Field of Search ..... 441/65, 68, 74, 79; 114/39.2; 440/14, 15, 22

[56] References Cited

U.S. PATENT DOCUMENTS

| | | | |
|---|---|---|---|
| 3,317,937 | 5/1967 | Gallagher | 441/74 |
| 3,371,642 | 3/1968 | Joy | 114/285 |
| 3,565,030 | 2/1971 | Curtis | 114/285 |
| 3,988,794 | 11/1976 | Tinkler et al. | 441/74 |

FOREIGN PATENT DOCUMENTS

| | | | |
|---|---|---|---|
| 2753031 | 5/1979 | Fed. Rep. of Germany | 441/74 |
| 2828859 | 1/1980 | Fed. Rep. of Germany | 441/74 |
| 30680 | 2/1982 | Japan | 114/39.2 |

*Primary Examiner*—Sherman D. Basinger

*Assistant Examiner*—Stephen P. Avila

*Attorney, Agent, or Firm*—Ralph S. Branscomb

[57] ABSTRACT

The rear end of a slab-type hull of the sort utilized for windsurfing, and also as disclosed herein adapted to be used in the place of a slalom ski, is horizontally bifurcated to define a rigid upper deck portion and a flexible deflection panel extending beneath, and spaced from, the upper rear deck portion. The deflection panel can flex upwardly independently of the upper, rigid rear deck. Although the flexure of the deflection panel beneath the upper rear deck is functional without any further controls or modifications other than the independent flexure of the deflection panel itself relative to the overlying upper rear deck, its characteristics are enhanced by incorporating certain control features in the nature of a detent element which fixes the curvature of the deflection panel, and/or one or more stops, preferably spring-loaded, which determine the uppermost deflection of a certain portion or portions of the deflection panel. When the hull is used with a windsurfer or in place of a slalom ski, it substantially enhances certain of the capabilities of the hull as are described in more detail herein.

6 Claims, 14 Drawing Figures

HULL CONSTRUCTION

BACKGROUND OF THE INVENTION

The invention is in the field of water sports, and more particularly relates to windsurfing and waterskiing, specifically waterskiing on a single ski, or "slalom" ski.

The sport of windsurfing or "sailboarding" was only invented about 15 years ago, as of the date of this application, and yet has become extremely popular, and has completely swept Europe. Sailboard races, various competitions, classes, and just sailboarding for the sport of it is popular in the United States and has taken Europe by storm.

Naturally, with the more advanced competitions and the increasing skill of users of the sailboards, and the increasing value of the prizes to the winners, the sailboards have become increasingly sophisticated, fast, flexible in use, and come in various shapes and sizes to accommodate the differing weights of riders as well as differing conditions and the different uses to which the sailboard will be put. Nonetheless, typically with any of the sailboards currently on the market, except in the very unlikely event that the sailboard will be used only in a specific type of weather and for a specific run at the same angle into the wind, compromises must be made between the different modes in which the board is used.

For example, when running the typical threelegged triangle of a race, the hull configuration is optimal if it is somewhat concave from fore to aft, particularly in its rearward section. The downsloping rear end will tend to hold the bow down in the water against the force of the head wind which would tend to roll the hull backwards and dig the stern into the water. However, when on a broad reach and on a run, such a concave hull contour would cause the prow to dig into the water and make it impossible to proceed with any speed. For this reason, a convex bottom hull contour is optimal for a broad reach or a run so that the bow or prow never "plows." Clearly, with a rigid hull a compromise must be reached resulting in a hull that is neither optimum for running or for pointing, but which will nevertheless function adequately in either capacity.

SUMMARY OF THE INVENTION

The present invention resolves the above-stated dilemma by providing a hull with a rear bottom portion which is a deflection panel, capable of altering the effective contour of the bottom of the hull. It is advantageous with or without any of the features which will establish the angle of the deflection panel. That is, the deflection panel alone, without any other structure, invests the hull with advantageous characteristics not found in a rigid hull. For example, when rounding the mark, the fairly high water pressure on the resilient deflection panel will cause it to bend upwardly, which establishes a relatively convex shape to the bottom of the hull enabling it to make a much tighter turn than a straight-bottomed hull.

When the deflection panel is fitted with an adjustable means for establishing it at a particular degree of deflection, the deflection panel can be established at the optimum angle for the particular maneuver being executed. For example, the deflection panel could be forced all the way down, forcing a concave contour to the bottom of the hull when close-hauled such as when heading for the first buoy in a standard regatta. As the first buoy is reached and the windsurfer must be jibed into a broad reach, the deflection panel can be established in a middle position, so that the bottom of the hull is neither very concave nor very convex.

When rounding the second buoy and heading for the finish line on a run, the deflection panel can be released or allowed to move into its uppermost position establishing the maximum convexity to the bottom of the hull to prevent it from plowing.

The same basic concept has been incorporated into a slalom ski which is different from any slalom ski on the market or that has been used in the past. The slalom ski of the instant invention, utilizing the tail section as described above, is of foam construction and is wide enough and thick enough to provide a great deal more buoyancy than a standard slalom ski, which has barely enough buoyancy to float itself, much less a rider. The combination of the wider, thicker board, being light in weight, with the deflection panel provides and entirely different ride. An intermediate user can actually kneel on the board and be at least partially floated, rather than starting deep in the water or on the shore as is necessary with a standard slalom.

Once underway, the deflection panel acts as a cushion when landing on the water from a jump, and also acts as a spring to enable the rider to leap off the wake of the towboat, for example.

In either implementation, variable stops could be used which define the upper limits of deflection of the deflection panel, either centrally, or on opposite sides of the center line of the hull. The adjustability of the stops, or one stop in the case of the slalom, enable the same board to be used with riders of different weights. The springs which surround the stop rods can also be exchanged for springs of greater or lesser strength to accommodate riders of different weights.

DETAILED DESCRIPTION OF THE PREFERRED EMBODIMENT

Figure 1:
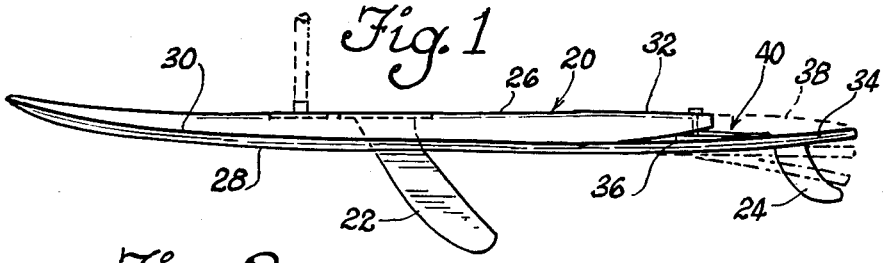
FIG. 1 is a side elevation view of the hull used in a sail-board configuration.

FIG. 1 illustrates a typical sailboard hull 20 with a center daggerboard 22 and a rear fin or skig 24. The hull has a top deck 26, a bottom 28, and side edges 30 which are generally called "rails." The deck tappers rearwardly to an upper rear deck 32 which is separated from the bottom rear of the hull which defines a deflection panel 34. A wedge 36 of open space is defined between the generally rigid upper rear deck 32 and the underlying deflection panel. A resilient, flexible foam saddle 38 can be inserted to continue the contour of the upper surface of the hull, although this is largely a cosmetic feature.

As described in the summary and the background, the use of the deflection panel without any further structure defines certain definite advantages over the use of the completely rigid hull. A twisting of the flex panel around curves helps make a tighter curve, and the flexibility gives the rider an additional feature with which to develop his creativity when it comes to jumps and landings. The springiness of the board when landing will enable a windsurfer who would otherwise founder when coming down from a high jump to land smoothly and continue along at substantially full speed. Use of the hull in its slalom's key configuration yields similar advantages.

Figure 5:
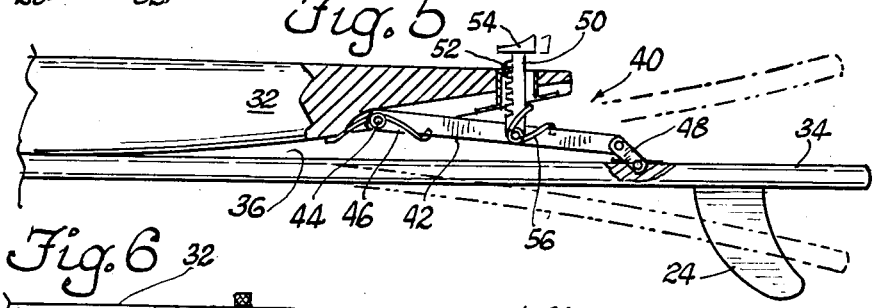
FIG. 5 is a side elevation with a portion cut away in section of the rear end of the hull configuration illustrated in FIGS. 1 and 2 as it would be seen from the section line at 5—5 in FIG. 2.
Figure 6:
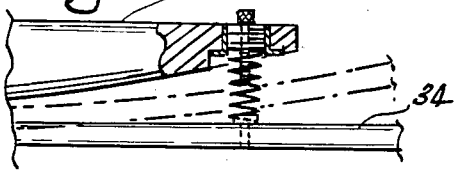
FIG. 6 is a section through the stop means taken along line 6—6 of FIG. 2.
Figure 8:
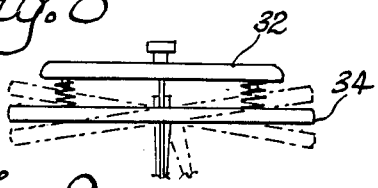
FIG. 8 is a rear elevation view taken along line 8—8 of FIG. 2, illustrating the manner in which the deflection panel twists about its longitudinal axes in phantom.

However, by the utilization of a means for fixing the deflection panel at a set degree of deflection, its utility is even more advantageous. As best shown in FIG. 5, one example of a means for establishing the desired degree of deflection in the panel 34 is indicated at 40. This particular arrangement utilized a principle length of rod 42 which is pivoted to the upper rear deck at 44 and is spring-loaded into the up position by means of spring 46. At the rear end of this length is a pivotal link, pivoted to both the rear end of the principle length 42, and the deflection panel. The pivotal length accommodates the different overall length of the panel fixing means which must be incorporated to accommodate the varying spacing between the two pivot points on the upper rear deck and the deflection panel as different degrees of deflection are established.

In order to maintain the deflection panel in a selected one of several degrees of deflection which are possible, in the illustrated embodiment a ratchet bar 50 is used in conjunction with a pawl 52, which could merely be a flange mounted in the upper rear deck as shown in FIG. 5.

The ratchet bar in the embodiment shown in FIG. 5 has a foot pad 54 on top, and is spring-loaded into the pawl-engaging position by means of spring 56. Thus, the rider on the hull can push rearwardly and downwardly on the foot pad to establish the maximum deflection of the deflection panel, or alternatively he can push the foot pad into disengagement with the pawl and release some pressure on the deflection panel so that it swings up into one of the uppermost positions illustrated in phantom in FIG. 5. Thus, the effective configuration of the bottom of the hull, or at least the rear portion of the hull, can be made to switch easily between convexity and concavity.

It should be noted that once the deflection panel is fixed by virtue of the fixing means 40, it will remain in that position independently of the position the rider assumes on the windsurfer. In other words, he or she has complete freedom of movement that he or she would need in a race or other competition except when actually making the change from one deflection panel configuration to another.

Figure 7:
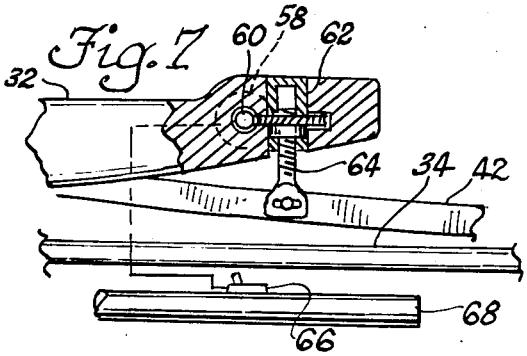
FIG. 7 is an elevational detail, partially in section, illustrating a motor-driven deflection variation system.
Figure 9:
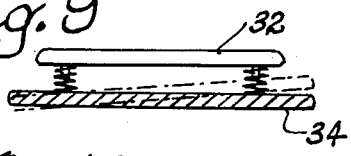
FIG. 9 is a section taken along line 9—9 in FIG. 3 illustrating the deflection of the deflection panel utilizing two spring-assisted stops.
Figure 10:
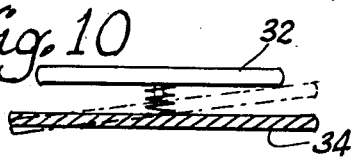
FIG. 10 is a section taken along line 10—10 illustrating in phantom the flexure of the deflection panel utilizing a single central stop.

To give the rider even more freedom from the demands of changing the deflection panel, as illustrated in FIG. 7 an embodiment could be used utilizing a small, possibly battery powered motor 58 which drives a worm shaft 60 which rotates an internally threaded collar 62 about the vertical axis, which in turn moves the threaded shaft 64 up and down to move the principle length 40 of the panel fixing means. The advantage of utilizing an electric motor like this is that it can be controlled from any part of the sailboard, such as by one or more switches 66 which could be mounted on the boom 68 of the sailboard. The operator has to have his hands on the boom anyway in order to control the sailboard so that it would be very simple to adjust and readjust the setting of the deflection panel during a race without sacrificing body position in the slightest.

In addition to the deflection fixing means, there is also illustrated a stop means which does not actually control precisely the position of the deflection panel, but rather defines its position of maximum upward deflection. Additionally, a coil spring around the maximum deflection stop rod provides increasing resistance as the deflection panel, or a portion thereof, approaches the positive stop of the bottom of the stop rod.

Figure 11:
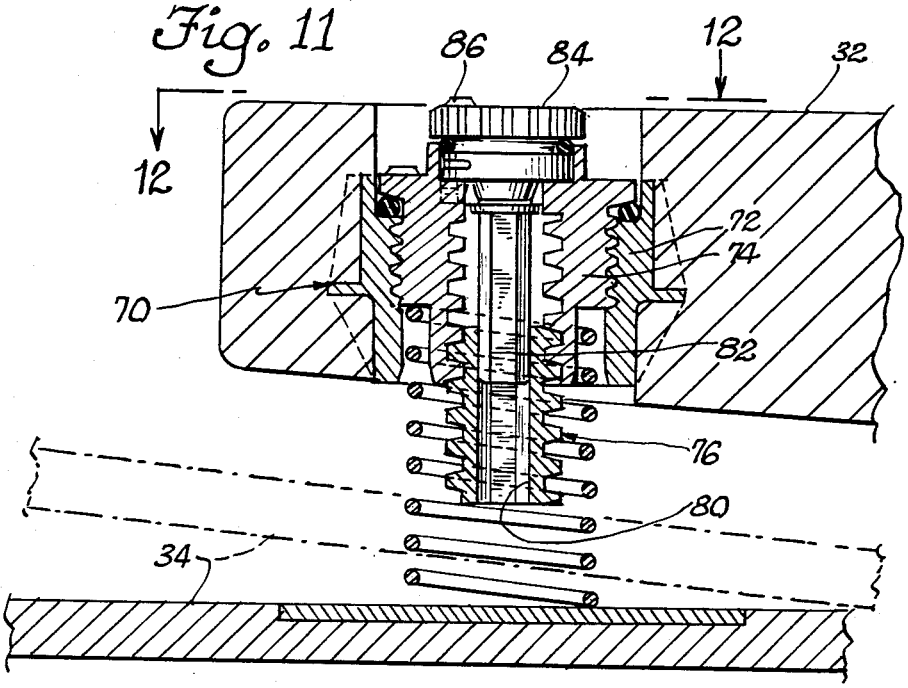
FIG. 11 is a detailed section taken through a typical spring-assisted stop illustrating the collar in the manner in which it is constructed and mounted in the upper rear deck portion of the hull.

A typical stop is illustrated in detail in FIG. 11. It consists of a collar 70 which is embedded in the foam and fiberglass of the upper rear deck. The collar has an outward, immobile portion 72 which is internally threaded, and an inner portion 74 which is screwed into the threaded outer portion and remains there semi-permanently.

Figure 12:
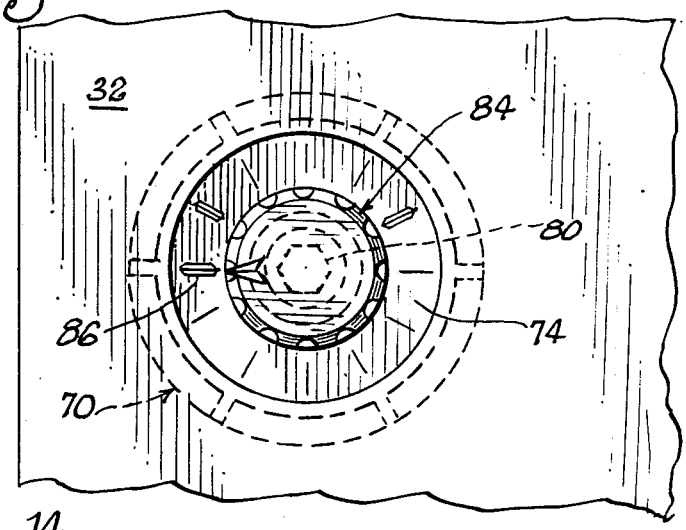
FIG. 12 is top plan view as seen along line 12—12 of FIG. 11 illustrating the top of the stop, with embedded portions of the stop illustrated in phantom.

The inside of the inner portion is also threaded and accommodates the similarly threaded stop rod 76. The stop rod will move up and down in the collar as it is rotated back and forth. Rotation is accomplished by virtue of the axial bore 80 in the stop rod which is noncircular. In the illustrated embodiment, it is hexagonal as shown in FIG. 12 at 80. A hexagonal shaft 82 has an integral knob 84 which snaps into place in the collar so that the shaft and knob will rotate freely, but cannot move axially.

As the knob is turned, it in turn turns the hexagonal shaft which rotates the rod 76, causing it to move up and down. The rod 76 is the stop rod, so that the effective stopping point defined for a particular part of the deflection panel is thus adjustable. The degree to which the stop rod is adjusted may be determined if an indexing system is used as shown in FIG. 12, which is a top view of the stop of FIG. 11. The knob 84 has a pointer 86 which will align with various ribs, numbers or other indicia on flat surrounding areas of the collar. This is important so that the user can determine from above how far down the stop rod is set. Normally the user would not be able to see around and beneath the upper rear deck to see how far down the rod extends.

Figure 2:
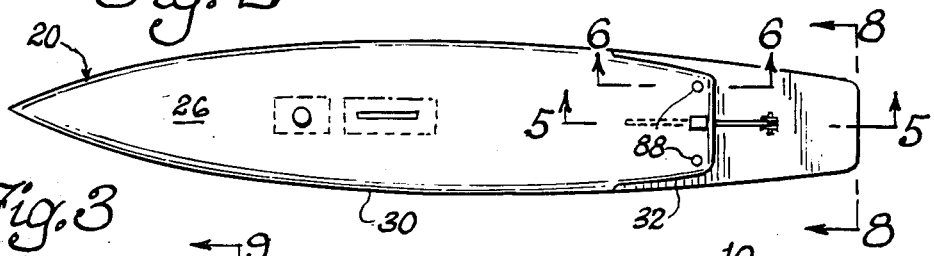
FIG. 2 is a top plan view of the hull of FIG. 1.
Figure 3:
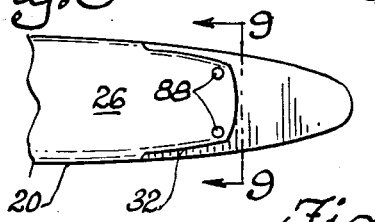
FIG. 3 is a partial top plan view of the rear end of the hull.

These stops may be used in a laterally spaced configuration on opposite sides of the center line of the hull, in conjunction with the deflection panel fixing means, as shown at 88 in FIG. 2. They could also be used without the center apparatus as shown in FIG. 3. The stops by themselves will establish a certain measure of control that is useful to the rider.

Figure 4:
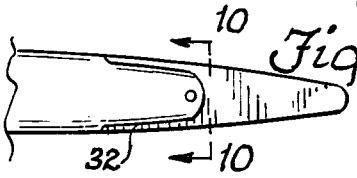
FIG. 4 is a partial top plan view of the rear end of a hull of the type that would typically be used in a slalom ski configuration.

FIG. 4 indicates a single, central stop. This figure illustrates the stern of a slalom ski. It is narrower than the windsurfer hull, and is shown in its overall configuration in FIG. 13. As discussed above, a single stop, with its capacity for varying the upper deflection of the deflection panel, can be used to accommodate different wake-riding conditions and different rider weights. By replacing the spring 88, which surrounds the stop rod and buttresses up against the bottom part of the collar 70, different riders can be easily accommodated.

Figure 13:
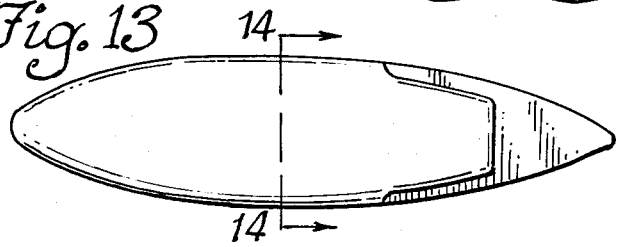
FIG. 13 is a top plan view of a typical slalom ski configuration.
Figure 14:
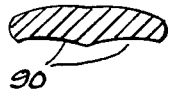
FIG. 14 is a typical section taken along line 14—14 of FIG. 13.

As indicated in FIG. 14, the configuration shown in FIGS. 13 and 14 differ from a typical slalom board in that there is a definite thickness in the board which provides floatation, and the underside is double concave as indicated at 90. The thickness, the floatation, and the resilient panel together cooperate to create what amounts to virtually a new board for a new sport. Riding the slalom-configured hull is substantially different and provides a different feeling than riding the conventional, thin wood slalom ski. In addition to providing floatation, it is "softer" in its landings, springier in its jumps, and generally easier to use on the one hand as well as being more exciting in its capabilities on the other, than a conventional slalom ski.

Thus, in either of the configurations, with or without the deflection panel fixing mechanism or the central or lateral spring-loaded stops, the deflection panel implementation in the windsurfer and the slalom ski creates a speed-maneuverability and jumping advantage in the windsurfer, and a riding ease and maneuvering flexibility in the slalom configuration, that is heretofore unknown in either sport. In addition, when adding the flexure fixing mechanism or the stops, even more control is provided to the user, augmenting the above-mentioned advantages to provide even more agility, speed, excitement and competitiveness than without these features. The invention is an important one in both of its implementations, and represents a sizable departure from the conventional approaches to the creation of hulls, even in considering the hightech nature of the approaches and designs of previous hulls.

I claim:

1. In a hull having a forward portion with a deck, bottom, and side rails, a rear hull portion comprising:

(a) a rigid upper rear deck defining a rearward continuation of the deck of said forward portion and being substantially rigid;

(b) a resilient bottom deflection panel defining a continuation of the bottom of said forward portion and extending beneath said rear deck and being upwardly deflectable independently of said rear deck such that increasing water pressure directed against the bottom of said deflection panel will increasingly deflect same into a curved configuration to alter the effective camber of the bottom surface of the hull;

(c) Means to substantially limit the upward deflection of at least a portion of said deflection panel at a determinable maximum degree of deflection;

(d) said means to substantially limit comprising a generally vertically adjustable rod projecting down from said rigid deck and acting as a stop for said at least a portion of said deflection panel;

(e) said rod being threadedly engaged in a threaded collar mounted in said upper rear deck and being manually rotatable in said collar to effect the vertical adjustment of said rod in said collar; and;

(f) said rod having a non-circular, substantially axial bore and including a shaft of substantially the same cross-section as said bore and fitting therein, said shaft having means to prevent its axial movement, and defining rotation-effecting means on the top thereof, whereas said shaft can be rotated by manual manipulation of said rotation-effecting means to effect the axial migration of said rod without the shaft moving axially.

2. Structure according to claim 1 wherein said rotation-effecting means comprises a knurled knob defined at the top of said shaft.

3. Structure according to claim 2 wherein said collar defines non-rotational areas around said knurled knob, and said non-rotational areas and rotational knurled knob together define indicia indicating the various degrees of relative rotation between said knob and said collar.

4. In a hull having a forward portion with a deck, bottom, and side rails, a rear hull portion comprising:

(a) a rigid upper rear deck defining a rearward continuation of the deck of said forward portion and being substantially rigid;

(b) a resilient bottom deflection panel defining a continuation of the botttom of said forward portion and extending beneath said rear deck and being upwardly deflectable independently of said rear deck such that increasing water pressure directed against the bottom of said deflection panel will increasingly deflect same into a curved configuration to alter the effective camber of the bottom surface of the hull;

(c) Means to substantially limit the upward deflection of at least a portion of said deflection panel at a determinable maximum degree of deflection;

(d) said means to substantially limit comprising a generally vertically adjustable rod projecting down from said rigid deck and acting as a stop for said at least a portion of said deflection panel;

(e) said rod being threadedly engaged in a threaded collar mounted in said upper rear deck and being manually rotatable in said collar to effect the vertical adjustment of said rod in said collar.

5. Structure according to claim 4 wherein said rod is singular and disposed substantially on the axial center line of said hull.

6. Structure according to claim 4 wherein said rod is duplicated and laterally spaced substantially symmetrically about the longitudinal center line at said hull.

* * * * *